US008833904B2

(12) United States Patent
Duke et al.

(10) Patent No.: US 8,833,904 B2
(45) Date of Patent: Sep. 16, 2014

(54) AUTOMATED PRINT AND IMAGE CAPTURE POSITION ADJUSTMENT

(75) Inventors: Ronald J. Duke, Centerville, OH (US); Brad Smith, Xenia, OH (US)

(73) Assignee: Eastman Kodak Company, Rochester, NY (US)

( * ) Notice: Subject to any disclaimer, the term of this patent is extended or adjusted under 35 U.S.C. 154(b) by 99 days.

(21) Appl. No.: 13/400,164

(22) Filed: Feb. 20, 2012

(65) Prior Publication Data

US 2013/0215165 A1 Aug. 22, 2013

(51) Int. Cl.
*B41J 2/145* (2006.01)

(52) U.S. Cl.
USPC ..... 347/40; 347/41; 347/19

(58) Field of Classification Search
USPC ..... 347/14, 15, 19, 40, 5, 9, 41
See application file for complete search history.

(56) References Cited

U.S. PATENT DOCUMENTS

| | | | | |
|---|---|---|---|---|
| 6,622,621 | B2 | 9/2003 | Bucher et al. | |
| 8,123,326 | B2 | 2/2012 | Saettel et al. | |
| 2006/0221124 | A1 * | 10/2006 | Guarino et al. | 347/40 |
| 2010/0123752 | A1 * | 5/2010 | Eun et al. | 347/19 |
| 2011/0074860 | A1 | 3/2011 | Saettel et al. | |

* cited by examiner

*Primary Examiner* — Lam S Nguyen
(74) *Attorney, Agent, or Firm* — William R. Zimmerli

(57) ABSTRACT

A first registration mark is printed by a first printhead on print media at a first initial encoder value. A second registration mark is printed by a second printhead on print media at a second initial encoder value. The second registration mark is spaced apart from the first registration mark. The first and second registration marks are detected using the mark detection system as each is transported past the mark detection system. The displacement signal is used to measure a displacement of the print media between the detection of the second and first registration marks by the mark detection system. A cue delay value is determined for the second printhead so that a subsequently printed first image plane and a second image plane are registered relative to each other using the displacement, the first initial encoder value, and the second initial encoder value.

9 Claims, 5 Drawing Sheets

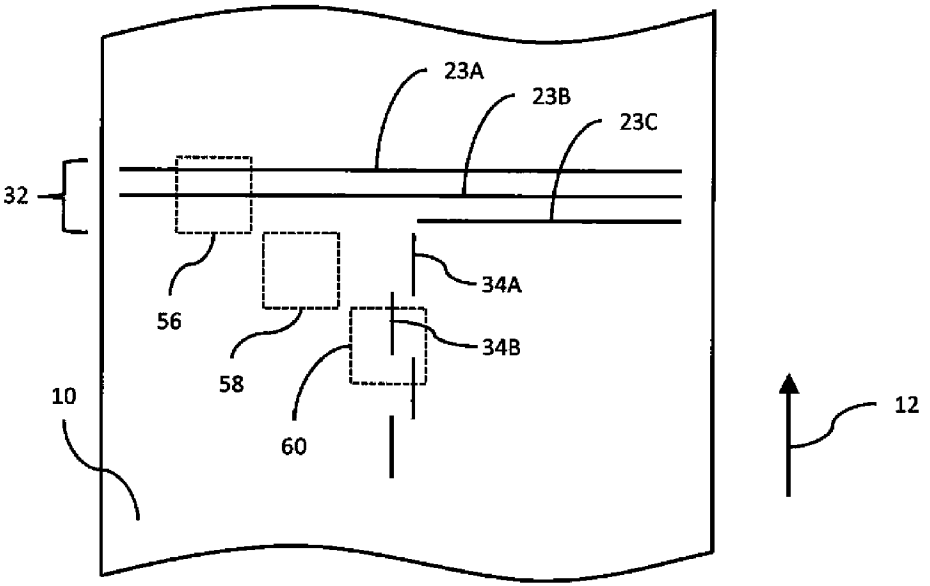
FIG. 5
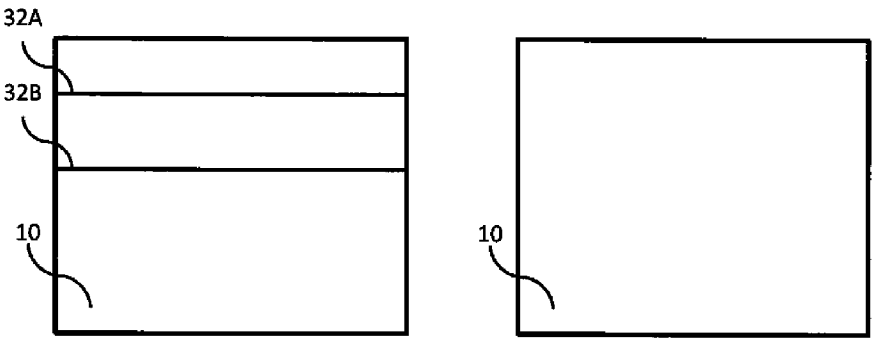
FIG. 6A
FIG. 6B
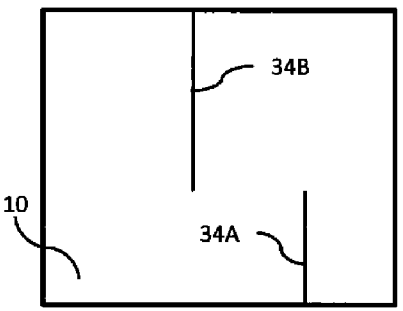
FIG. 6C

AUTOMATED PRINT AND IMAGE CAPTURE POSITION ADJUSTMENT

CROSS REFERENCE TO RELATED APPLICATIONS

Reference is made to commonly-assigned, U.S. patent application Ser. No. 13/400,169, entitled "AUTOMATED PRINT AND IMAGE CAPTURE POSITION ADJUSTMENT", filed concurrently herewith.

FIELD OF THE INVENTION

This invention relates generally to digitally controlled printing systems and, in particular, to the registration of image planes printed by these systems.

BACKGROUND OF THE INVENTION

In digital printing systems that employ multiple printheads to print images on a print media, a system or method for adjusting the registration of the print from the multiple printheads is necessary to ensure that the image planes printed by the individual printheads are in proper alignment with each other. Such a system provides a means to compensate for the stack up of positioning tolerances for the printheads in the printing system. Some registration systems also provide a means to compensate for expansion and contraction of the print media as is passes from one printhead to another within the printing system.

In US Patent Application Publication No. 2011/0074860, multiple image planes are printed by the multiple printheads. Each image plane includes a test mark. Downstream of the printheads, a camera or other image capture device captures an image that includes the test marks from each image plane. The captured image is analyzed to determine the relative position of the test marks. The determined relative positions are compared with the intended relative positions to determine the amount and direction by which the various image planes should be adjusted to yield the proper registration. The appropriate adjustments can be made producing properly registered images. This registration technique, and many others, uses a minimum threshold level of registration. If the misregistration is excessive, some of the test marks may lie outside the field of view of the camera or outside of image processing area of interest in images captured by the camera, or the placement of the test marks within the image may be so far from their intended locations that they lead to ambiguity as to which image plane a test mark is associated with.

There is a need therefore for an improved technique for registering the various image planes printed by a digital printing system in the in-track direction (the direction of motion of the print media) of media travel and in the crosstrack direction (across the width of the print media) of media travel.

SUMMARY OF THE INVENTION

According to an aspect of the present invention, a method for registering image planes in a digital printing system is provided. The digital printing system includes a first printhead spaced apart from a second printhead.

The first printhead prints a first image plane and the second printhead prints a second image plane along a transport path for transporting a print media. The second printhead is located downstream of the first printhead. In the method, a controller is provided to control the operation of the digital printing system. A media transport is provided for moving the print media relative to the first and second printheads. The media transport includes an encoder for transmitting a displacement signal to the print controller. A mark detection system is provided and located downstream of the first and second printheads.

The first printhead is caused to print a first registration mark on the print media at a first initial encoder value. The second printhead is caused to print a second registration mark on the print media at a second initial encoder value. The second registration mark is spaced apart from the first registration mark.

The first registration mark and the second registration mark are detected using the mark detection system as each is transported past the mark detection system. The displacement signal is used to measure a displacement of the print media between the detection of the second registration mark and the detection of the first registration mark by the mark detection system. A cue delay value is determined for the second printhead so that a subsequently printed first image plane and a second image plane are registered relative to each other using the displacement, the first initial encoder value, and the second initial encoder value.

BRIEF DESCRIPTION OF THE DRAWINGS

In the detailed description of the example embodiments of the invention presented below, reference is made to the accompanying drawings, which:

FIG. 5 is a schematic view of the first registration mark as the image capture device uses the first guiding feature to determine the location of the first crosstrack locating feature; and FIGS. 6A, 6B, and 6C are schematic views from the image capture device in various positions, shown in FIG. 5, relative to the first guiding feature and the first crosstrack location feature.

DETAILED DESCRIPTION OF THE INVENTION

Figure 1A:
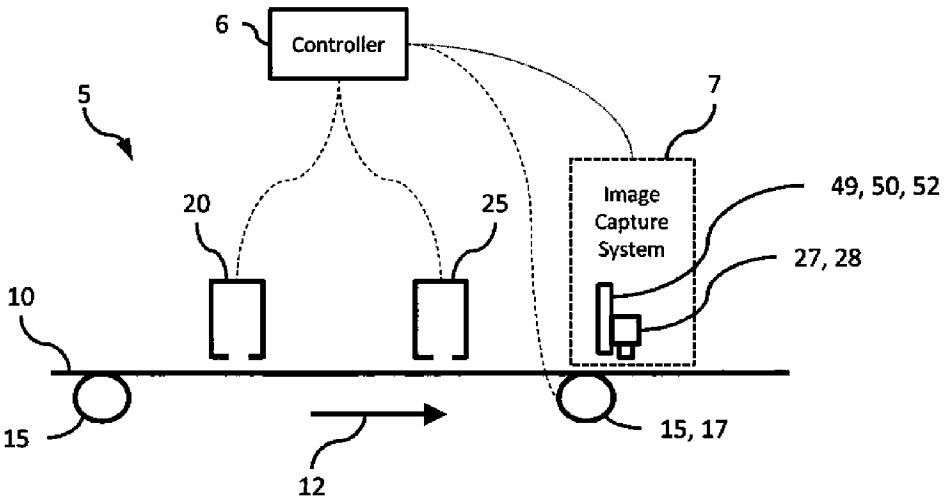
FIG. 1A is a schematic side view of a digital printing system including an image capture system for registering a first image plane and a second image plane printed on a print media.

The present description will be directed in particular to elements forming part of, or cooperating more directly with, an apparatus in accordance with the present disclosure. It is to be understood that elements not specifically shown, labeled, or described may take various forms well known to those skilled in the art. In the following description and drawings, identical reference numerals have been used, where possible, to designate identical elements. The example embodiments of the present invention are illustrated schematically and not to scale for the sake of clarity. One of ordinary skill in the art will be able to readily determine the specific size and interconnections of the elements of the example embodiments of the present invention.

It is to be understood that elements and components may be referred to in singular or plural form, as appropriate, without limiting the scope of the present invention. Additionally, references such as first, second, etc. are intended only for reference purposes only, and should not be interpreted as to mean that any specific order is intended or required for the present disclosure to function properly.

FIG. 1A shows a digital printing system 5 that includes a first printhead 20 and a second printhead 25. Each printhead may comprise one or more jetting modules, wherein each jetting module has an array of nozzles, typically fabricated in a single nozzle plate. The first printhead 20 prints a first image plane on the print media 10 as the print media is moved relative to the first printhead. The second printhead 25 prints a second image plane on the print media 10 as the print media is moved relative to the second printhead. The second printhead 25 is spaced apart from the first printhead 20. The second printhead is located downstream of the first printhead along the path of media travel through the printing system. The first and second printheads are supplied with print data by and controlled by a controller 6. The print media is moved relative to the first and second printheads in a feed direction 12 by a media transport 15, which is also under the control of the controller 6. The media transport 15 includes an encoder 17 for monitoring the motion of the media through the printing system. Typically the encoder comprises a rotary encoder coupled to a roller over which the print media moves; the encoder producing a signal pulse whenever the print media is displaced by a distance characteristic of the encoder. The output signal from the encoder typically goes to a counter, which counts the signal pulses from the encoder to create an encoder count value. The signal from the encoder may be conditioned by a signal conditioning circuit before being sent to the counter. The signal conditioning may include filtering the signal to filter out noise and combining the normal and quadrature signals from the encoder to create a single signal.

To get the print from the second printhead to register with the print from the first printhead, the print from the second printhead is delayed relative to the print from the first printhead. The delay corresponds to the time for the print media to move from the first printhead to the second printhead. As the motion of the print media through the printing system is monitored by the encoder 17, it is common to define the delay in terms of a count of the encoder pulses, called a cue delay.

While the embodied digital printing system comprises a web feed media transport, the invention is not limited to web feed media transports. The invention may also be used with other media transports including sheet feed media transports.

The digital printing system 5 also includes an image capture system 7, which is positioned adjacent to the print media downstream of the first and second printhead so that the image capture system can acquire images of portions of the first and the second image planes marks printed by the first and the second printheads. The image capture system 7 includes a mark detection device 28 for detecting marks printed by the first and the second printheads. In some embodiments, the mark detection device 28 comprises an image capture device 27, such as a camera, for capturing an image of the print media 10. In other embodiments, the mark detection device 28 comprises a simple photodetector that senses the light reflected from a single spot. In some embodiments, the image capture device 27 comprises a two dimensional optical sensor array for capturing an image of the print media. In other embodiments, the image capture device 27 comprises a linear optical sensor array that acquires a sequence of one dimensional images as the print media is moved past the image capture system. An image processor is used to assemble two dimensional images from the sequence of one dimensional images. The image processor, not shown, may be part of the image capture system 7 or may be part of the controller 6. The image capture system also typically includes an illumination source, not shown, to illuminate the field of view of the mark detection system. In some embodiments where the mark detection system comprises an image capture device, the illumination source provides short strobe flashes of light to enable the image capture device to acquire an image without motion blur, while in other embodiments, the illumination source provides a constant level of illumination and the image capture device has a quick enough shutter or image acquisition time to avoid motion blur.

Figure 3B:
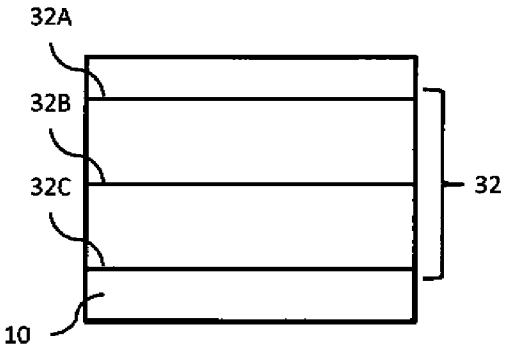
FIGS. 3A and 3B are a schematic view of a cross section of the image capture system where the image capture device is positioned near a first edge of the print media and a schematic view from the image capture device.
Figure 3A:
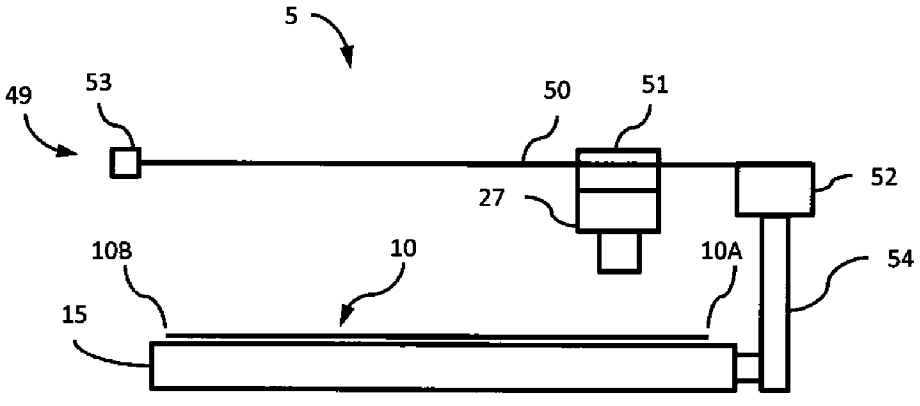
Figure 4B:
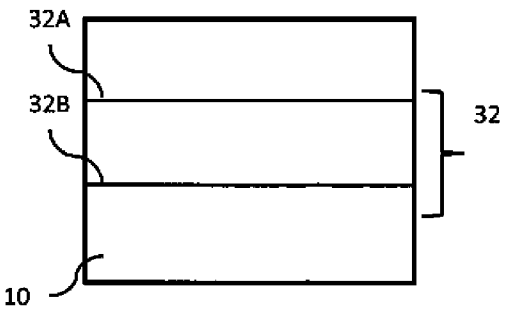
FIGS. 4A and 4B are a schematic view of a cross section of the image capture system where the image capture device is positioned near a second edge of the print media and a schematic view from the image capture device.
Figure 4A:
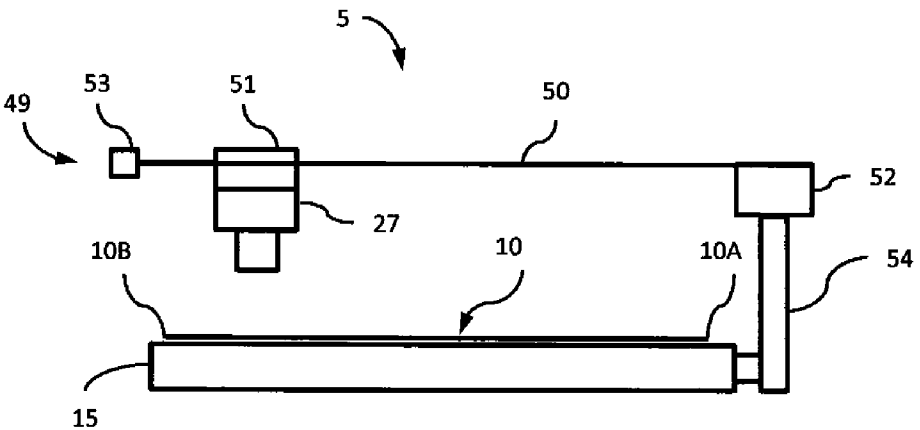

In some embodiments, the images captured by image capture device 27 can span the entire width of the print media passing through the printer or the width of the print zone that can be printed by the printheads of the digital printing system 5. In other embodiments the field of view of the image capture device is much less than the print width of the digital printing system. The image capture system can include a camera positioning system 49. The camera positioning system typically includes a carriage to which the camera or other image capture device 27 is mounted. The carriage, with the image capture device 27, is moved along a guide track or rail 50 by a drive system 52 so the image capture device can acquire images at different positions across the width of the print media, as shown in FIG. 3A and FIG. 4A. In some embodiments, the drive system also includes an encoder (not shown) for determining the crosstrack position of the image capture device 27. In other embodiments, in which the drive system uses a stepper motor to move the image capture device, the crosstrack position of the image capture device is determined by counting the number of pulses sent to the stepper motor.

Figure 1B:
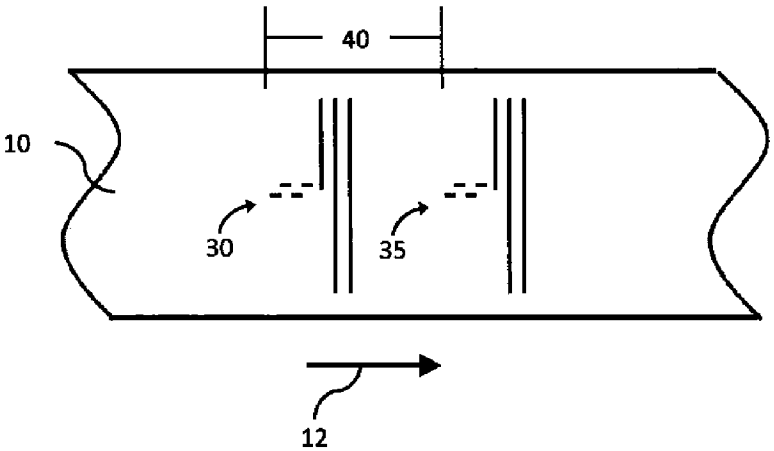
FIG. 1B is a schematic view of a first registration mark printed on the print media spaced apart from a second registration mark printed on the print media.

In-track registration of the image planes printed by digital printing system 5 will now be described. Referring to FIG. 1B, with the print media 10 being moved through the digital printing system 5 by the media transport 15, the control directs the first printhead 20 to print a registration mark 30 on the print media 10 when the output encoder is at a first initial encoder value, E1*i*. The encoder value corresponding to a count of encoder pulses. When the encoder value is at a second initial encoder value, E2*i*, the controller has the second printhead 25 print a second registration mark 35 on the print media 10. The first initial encoder value and the second initial encoder value are selected so that the first registration pattern and the second registration pattern are spaced apart from each other. This ensures that the image capture system 7 can detect the two registration marks with no ambiguity as to which registration mark is being detected when. Typically the first initial encoder value and the second initial encoder value are the same value, so that the first registration mark 30 and the second registration mark are printed concurrently. When the first and second registration marks are printed concurrently, the spacing between the first registration mark and the second registration mark equals the distance along the paper path between the first printhead and the second printhead.

The controller also directs of the image capture system 7 to activate the mark detection device 28 so that it can detect the registration marks when they are moved past the mark detection device by the media transport. In embodiments in which the mark detection device comprises a single photodetector or other non-imaging mark detector, the desired cue delay to register the images of the first and second printheads is determined in the following manner. When the second registration mark 35 (printed downstream of the first registration mark, closer to the mark detection device) passes the mark detection device 28, it is detected by the mark detection device, and the current encoder value at that time is saved as the second final encoder value, E2*f*. When the first registration mark is detected passing the mark detection device 28, the current encoder value at that time is saved as the first final encoder value, E1*f*.

The proper cue delay, Dc, for the second printhead relative to the first printhead is given by the following equation:

$$Dc=E1f-E2f+(E2i-E1i)$$

In some embodiments the saving of the encoder values and the calculation of the cue delay value Dc is carried out by the controller 6, while in other embodiments these actions are carried out by a processor in the image capture system 7.

When the mark detection device comprises a camera or other image capture device, activating the mark detection device involves beginning to acquire a sequence of images of the print media. These images are typically acquired at a rate that ensures some overlap between the images so that a top portion of one image duplicates the bottom portion of a preceding image (in the direction of media travel). This reduces the likelihood of a registration mark being missed by the image capture device due to landing in a gap between consecutive images. Each of the images or pictures in the sequence of images is associated with a picture encoder value, Ep1, the encoder count value at the time the picture i was acquired. These images are each analyzed by an image processor to determine whether a captured image includes a registration mark. When the second registration mark is identified in a captured image, its in-track position of the mark within the image, P2, is determined. This position within the image P2 is added to the picture encoder value Ep2 for the image that includes the second registration mark to yield the second final encoder value E1*f* with E2*f*=Ep2+P2. In a similar manner, when the first registration mark is detected within a captured image or picture the in-track position of the mark within the picture P1 is added to the picture encoder value for that image Ep1 to yield the first final encoder value E1*f* with E1*f*=Ep1+P1. As the in-track position of the mark within the image is typically measured in terms of pixels in the image, and the picture encoder value is measured in terms of counts of encoder pulses, which are produced every time the print media advances the defined distance characteristic of the encoder, some scaling may be required to convert the in-track position of the mark within the image value into the units of encoder counts before adding the in-track position of the mark within the image to the encoder count. The use of the calculated cue delay Dc during subsequent printing allows the subsequently first and second image planes to be registered. In some embodiments the subsequently printed first image plane includes a first print-time crosstrack registration mark and subsequently printed second image plane includes a second print-time crosstrack registration mark to enable the registration of subsequently printed images to be refined using an image registration system such as the one described in US Patent Application Publication No. 2011/0074860, the disclosure of which is incorporated herein in its entirety.

Figure 2:
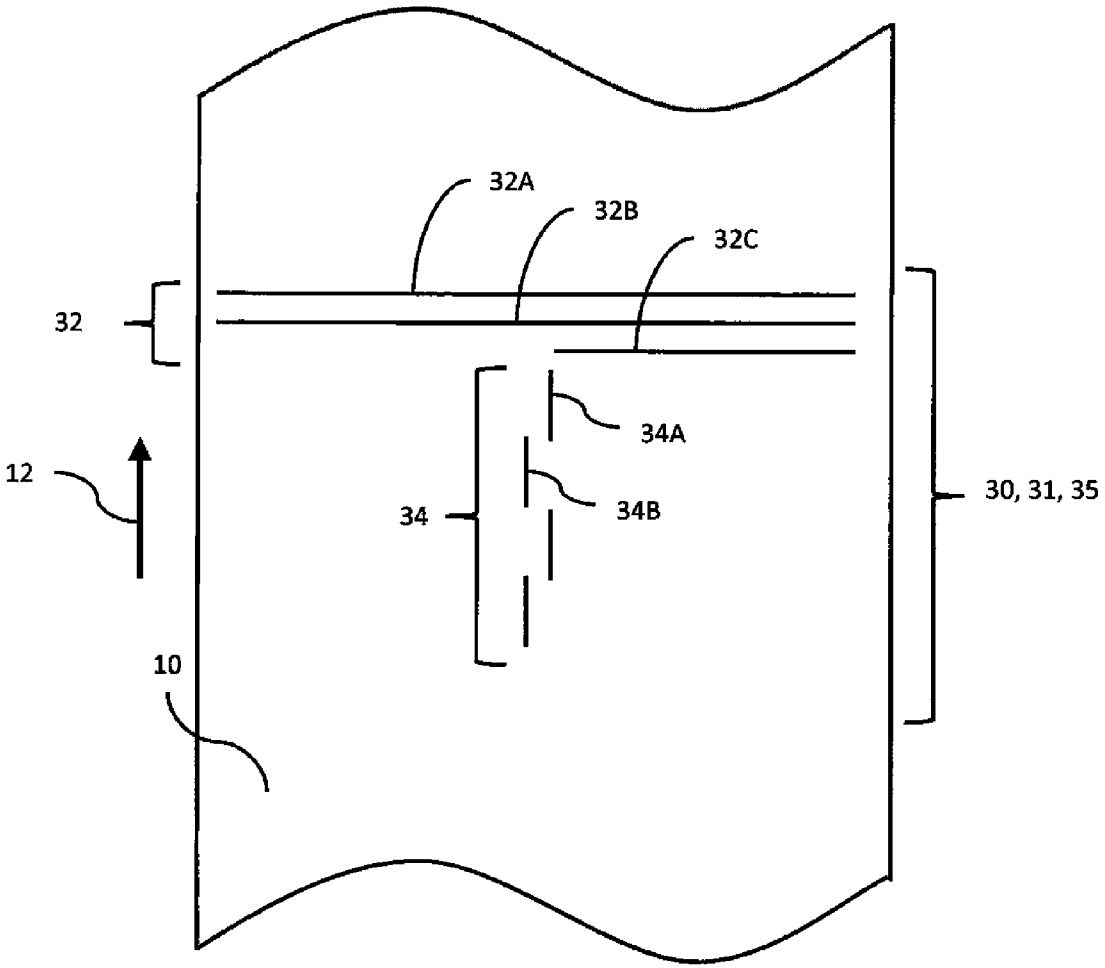
FIG. 2 is a schematic detail view of the first registration mark including a first guiding feature and a first crosstrack locating feature.

FIG. 2 shows an embodiment of a registration mark 31, which can be used as the first registration mark 30 printed by the first printhead and as the second registration mark 35 printed by the second printhead. The registration mark 31, include two lines 32A and 32B that span substantially the entire print zone of the digital printing system and that are oriented in the crosstrack direction, perpendicular to the direction of paper motion. These lines serve as in-track locating features for the registration marks, providing a well defined position in the in-track position for the measurement of the in-track distance from one registration mark to another. Typically the line 32A is printed at the encoder initial value, E1*i* or E1*i*, that defines the initiation of the printing of the corresponding registration mark. These lines can be readily detected by an imaging or non-imaging mark detection system, independent of the placement of the mark detection system in the crosstrack direction. The lines 32A and 32B have a known spacing between them. A comparison of the spacing of lines detected by the mark detection device with the known spacing of the line can be used to validate that the detected lines correspond to the lines of the registration mark. A third line 32C spans approximately one half of the print zone.

The registration mark shown in FIG. 2 also includes a crosstrack locating feature 34 that enables a determination of the registration of the first and second image planes in the crosstrack direction. In this embodiment, the crosstrack locating feature 34 includes a first lateral feature 34A and a second lateral feature 34B. These first and second lateral features are line segments oriented parallel to the direction of paper motion. These line segments are of known length and have a known spatial relationship to each other, for example, a known crosstrack distance between the line segments and known in-track distance between when one line segment ends and the other line segment begins. This enables a validation that detected features are the proper crosstrack locating features. The crosstrack locating features of the first registration mark and the crosstrack locating features of the second registration each have known intended crosstrack locations. Typically, these intended crosstrack locations are approximately the same so that the image capture device doesn't need to be repositioned in the crosstrack direction between the image capture of the crosstrack locating features of the second registration mark and the image capture of the crosstrack locating features of the first registration mark.

Using the image capture device 27 of the image capture system 7, an image is captured that includes the crosstrack locating feature of the first registration mark and an image is captured that includes the crosstrack locating feature of the second registration mark. An image processor can then determine the crosstrack location within the captured images of the crosstrack locating feature of both the first and second registration marks. The relative crosstrack spacing of the detected crosstrack locating features of the first registration mark to the detected crosstrack locating features of the second registration mark can then be determined. The determined relative crosstrack spacing of the crosstrack locating features of the two registration marks are compared to the intended crosstrack spacing of the crosstrack locating features of the first registration mark to the crosstrack locating features of the second registration mark to determine the crosstrack offset between the image planes. The crosstrack offset between the image planes corresponds to the amount of a lateral shift value for the second printhead required to register the first image plane and the second image subsequently printed by the first printhead and second printhead using the lateral displacement.

In some embodiments, the lateral position of the one or both of the first and the second printhead are moved to bring about the desired the desired lateral shift. In some embodiments, the digital printing system includes actuators (not shown) controlled by the controller 6 which move the printhead in the crosstrack direction. In other embodiments, the controller provides feedback to the operator to enable the operator to adjust the crosstrack position of one of the printheads as needed. In other embodiments, the crosstrack position of the printhead is left unchanged. In these embodiments, the data sent to the printheads is altered to cause the print to be shifted in the crosstrack direction by one or more jet spacings.

The crosstrack locating features 34 provide a clear reference for measuring the crosstrack placement of the individual registration marks 31. It is however necessary to have the image capture device properly located so that the crosstrack locating features are included in the captured images. For an initial test, there may be sufficient crosstrack positioning latitude for the individual lineheads and for the image capture device that the default or initial position of the image capture device is not aligned with the printed crosstrack locating features of the registration mark. In such cases, it would be necessary to shift the image capture device laterally to get it aligned with the crosstrack locating feature. In FIG. 2, the lines 32A, 32B and 32C serves as guiding features to enable the image registration system to determine which direction, left or right, to shift the image capture device to align it with the crosstrack locating features.

In the registration mark of FIG. 2, there are three lines (32A, 32B, and 32C) to the right of the crosstrack locating features and two lines (32A, 32B) to the left of the crosstrack locating features. By counting the individual lines of the guiding feature 32 captured in an image by the image capture device, the processor associated with the image capture system can determine whether to shift the camera to the left or right. By way of example, FIG. 3A shows a cross section view of the image capture system. In this figure, the image capture device 27 has been positioned by the camera positioning system 49 near the first edge 10A of the print media 10. An image, FIG. 3B, captured by the image capture device 27 includes the three lines 32A, 32B, and 32C of the right side of the guiding pattern. On the other hand, when the image capture device is positioned by the camera positioning system 49 near the second edge 10B of the print media, as shown in FIG. 4A, the captured image, shown in FIG. 4B, includes only the two lines 32A and 32B of the left side of the guiding feature 32.

FIG. 5 shows a portion of the print media with a registration mark 31 printed on it. The camera, initially positioned over the print media to the left of the crosstrack locating feature 34, captures an initial image whose field of view 56 is denoted by the dashed box. FIG. 6A shows the resulting captured image, which includes the two lines 32A and 32B that make up the left portion of the guiding feature 32. The processor of the image capture system 7 determines that the camera is to the left of the crosstrack locating feature 34, based on the detection of only two lines of the guiding feature. It then directs the camera positioning system to begin moving the camera to the right. During this time the print media has continued to move along the media transport in the direction indicated by arrow 12. When the camera captures the next image, the field of view 58 of the camera is shifted down and to the right (in FIG. 5) due to the motion of the print media and the motion of the camera. The captured image is shown in FIG. 6B. As the processor doesn't detect the crosstrack locating feature in this captured image, the camera continues to move to the right. A third image is captured. The field of view 60 of the camera is shown in FIG. 5. The captured image, shown in FIG. 6C, includes crosstalk location feature made up of line segments 32A and 32B. Having identified the crosstalk locating feature in the captured image, the processor of the image capture system 7 causes the camera positioning system to stop moving the camera. In some embodiments, the camera is adjusted so that the crosstrack locating feature is centered in the field of view of the camera. In a similar manner, the image capture device can be positioned to capture an image of the crosstalk locating features, based on the detected guiding features, for the registration marks printed by each linehead of the printing system.

In the embodiments of the camera positioning system 49 shown in FIGS. 3A and 4A, the camera positioning system includes several components. The camera or image capture device 27 is moved along a drive track 50 by means of a drive system 52. The camera is attached to a carriage, 51, that slides along rails or guiding rods of the drive track 50. The drive track 50 located above and parallel to the print media by a structure 54 that attaches to the media transport 15. A roller of the media transport 15 supports the print media 10 so that the print media doesn't flutter, vibrate vertically, within the field of view of the camera. In some embodiments the drive system comprises a motor driven lead screw that engages the carriage to move it laterally. In other embodiments, the drive system comprises a motor driven belt drive used to move the carriage 51. These drive systems are provided by way of example, but the invention is not limited to the use of these drive systems. In some embodiments, the camera positioning system 49 also includes an encoder 53 for determining the position of the camera 27 in the crosstrack direction. The encoder can be a linear encoder that directly measures the position of the carriage 51, or it can comprise a rotary encoder that measures the rotation of the lead screw that drives the carriage, or the rotation of a pulley in a belt drive system. In other embodiments, a counting of drive pulses to stepper motors of the drive system is used to determine the crosstrack position of the camera.

Figure 8:
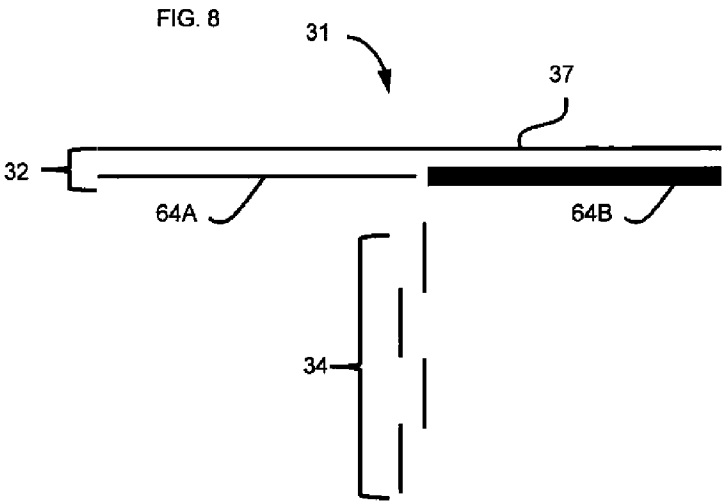
FIGS. 7-10 are alternative embodiments of registration marks including alternative embodiments of guiding features.
Figure 7:
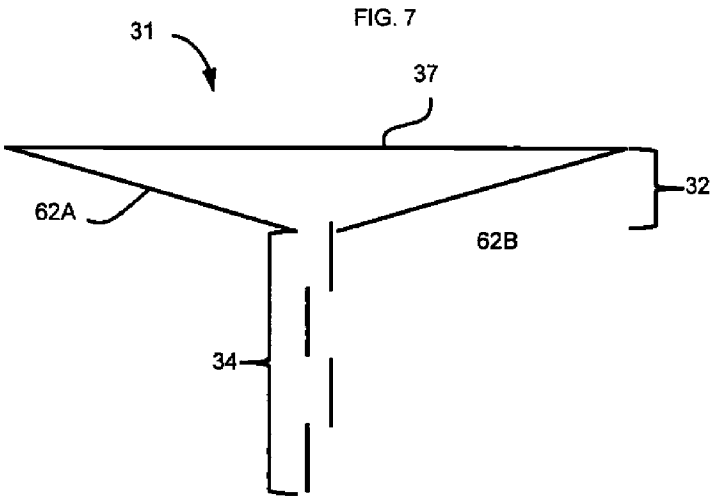
Figure 10:
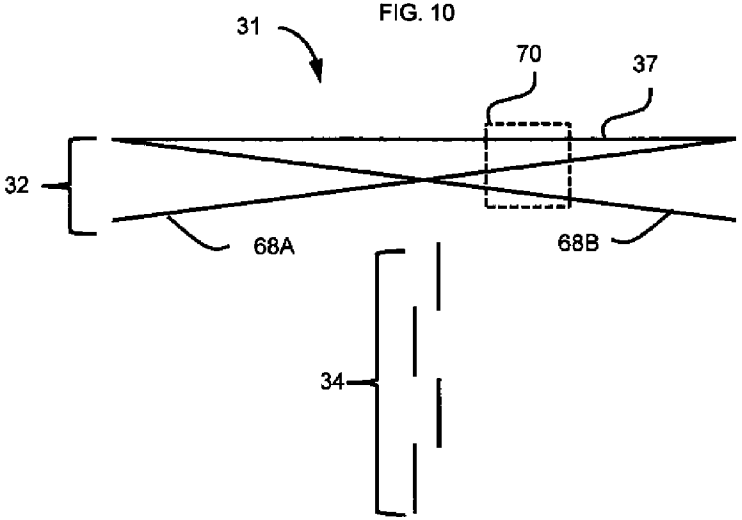
Figure 9:
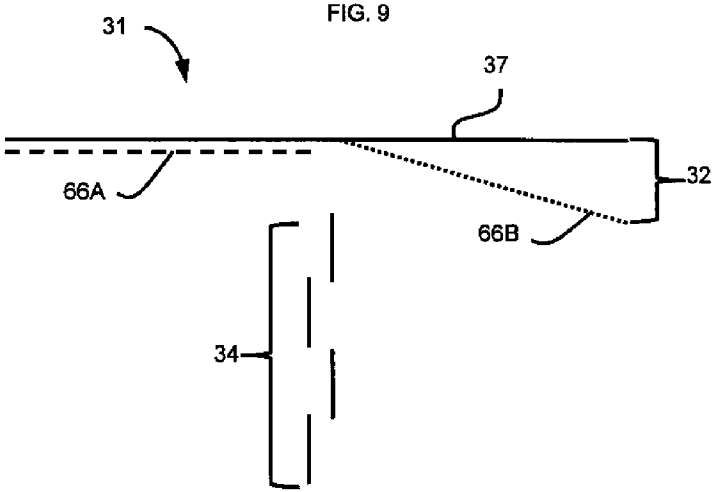

The guiding feature 32 of the registration mark 31 shown in FIG. 2, in which the number of lines 32A, 32B, 32C change from one side of the crosstrack locating feature to the other, is just one embodiment of a guiding feature. Many other guiding feature designs can be used in the present invention. FIGS. 7-11 illustrate several alternative registration mark designs. Each of these embodied registration marks 31, includes a line aligned with the crosstrack direction to serve as an in-track locating feature 37. Each of these illustrated registration marks 31 include a crosstrack locating feature 34. Each of these registration marks also include a guiding feature 32 that changes in some characteristic manner from one side of the crosstrack locating feature to the other. When these guiding features are captured in an image by the image capture device, the identified characteristic of the guiding feature provides an indication as to which direction to shift the camera to capture an image that includes the crosstrack locating feature 34. In the embodiment of FIG. 2, the number of lines 32 that make up the guiding feature is the characteristic that changes from one side of the crosstrack locating feature to the other. In FIG. 7, the tilt of the guiding feature lines 62A and 62B changes sign from one side to the other of the crosstrack locating feature to the other. In FIG. 8, the width of the lines 64A and 64B that make up the guiding feature is the characteristic that changes. FIG. 9 shows an embodiment in which a line 66A that is parallel to the in-track locating feature line 37 on one side of the crosstrack locating feature, while the line 66B is clearly angled relative to the in-track locating feature line. Furthermore line 66A is a dashed line, which can clearly be discerned from the dotted line nature of line 66B. In FIG. 10, the guiding feature comprises two intersection lines 68A and 68B. FIG. 10 also includes a box 70 to denote the field of view of an exemplary captured image. The position of the positive (upward) sloping lines 68A and negative (downward) sloping line 68B relative to each other and to the in-track locating feature 37 in the captured image provides the indication of which side of the crosstrack locating feature the camera is located. Furthermore an analysis of the spacing between the lines at one or more defined positions across the captured image can provide an indication as to the distance the camera must be shifted to align the left-right center position of the camera field of view with the intersection point of the intersecting lines. These examples of guiding feature designs are not exhaustive. Many other combinations of differing line number, line width, line type (solid, dashed, dotted, etc.), line slope, and curvature of the lines can be used as guiding feature to aid the image capture system in determining where to position the camera to capture an image of the crosstrack location feature.

The invention has been described in detail with particular reference to certain preferred embodiments thereof, but it will be understood that variations and modifications can be effected within the scope of the invention.

PARTS LIST

5 Digital printing system
6 Controller
7 Image capture system
10 Print media
10A First edge
10B Second edge
12 Feed direction
15 Media transport
17 Encoder
20 First printhead
25 Second printhead
27 Image capture device
28 Mark detection device/system
30 First registration mark
31 Registration mark
32 Guiding feature
32A First cross line
32B Second cross line
32C Partial line
34 Crosstrack locating feature
34A First lateral feature
34B Second lateral feature
35 Second registration mark
37 In-track locating feature
40 Displacement
49 Camera positioning system
50 Drive track
51 Carriage
52 Drive system
54 Structure
56 Field of view
58 Field of view
60 Field of view
62 Line
64 Line
66 Line
68 Line
70 Box

The invention claimed is:

1. A method for registering image planes in a digital printing system having a first printhead spaced apart from a second printhead, the first printhead for printing a first image plane and the second printhead for printing a second image plane along a transport path for transporting a print media in a direction, the second printhead being located downstream of the first printhead, the method comprising:

providing a controller to control the operation of the digital printing system;

providing a media transport for moving the print media relative to the first and second printheads, the media transport including an encoder for transmitting a displacement signal to the print controller;

providing a mark detection system located downstream of the first and second printheads;

causing the first printhead to print a first registration mark on the print media at a first initial encoder value;

causing the second printhead to print a second registration mark on the print media at a second initial encoder value, the second registration mark being spaced apart from the first registration mark in an in-track direction which is in the direction of print media motion;

detecting the first registration mark and the second registration mark using the mark detection system as each is transported past the mark detection system;

measuring a displacement of the print media between the detection of the second registration mark and the detection of the first registration mark by the mark detection system using the displacement signal; and determining a cue delay value for the second printhead so that a subsequently printed first image plane and a second image plane are registered relative to each other using the displacement, the first initial encoder value, and the second initial encoder value, wherein the subsequently printed first image plane includes a first print-time crosstrack registration mark and subsequently printed second image plane includes a second print-time crosstrack registration mark to refine the registration of first image plane and the second image planes.

2. The method of claim 1, wherein the first initial encoder value and the second initial encoder value are the same, such that the first registration mark and the second registration mark are printed concurrently.

3. The method of claim 1, wherein the second registration mark is spaced apart from the first registration mark by the same distance that the second printhead is spaced apart from the first printhead.

4. The method of claim 1, wherein the mark detection system comprises an image capture device.

5. The method of claim 4, the image capture device comprising a camera.

6. The method of claim 1, wherein the mark detection system includes a photo diode.

7. The method of claim 1, wherein the first image plane and the second image planes comprise different color image planes.

8. The method of claim 1, wherein the first image plane is printed a first side of the print media and the second image plane is printed on a second side of the print media.

9. The method of claim 1, wherein the first and second print-time crosstrack registration marks are positioned such that each can be captured simultaneously in a single image captured by the image capture device.

* * * * *